US006684795B2

(12) United States Patent
Villar et al.

(10) Patent No.: US 6,684,795 B2
(45) Date of Patent: Feb. 3, 2004

(54) RAILROAD CAR WITH SYSTEM FOR TRANSPORTING AND UNLOADING CARGO

(75) Inventors: Christopher M. Villar, Georgetown, TX (US); Garry Meyers, Council Bluffs, IN (US); Steven C. Orrell, Georgetown, TX (US)

(73) Assignee: Georgetown Rail Equipment Company, Georgetown, TX (US)

( * ) Notice: Subject to any disclaimer, the term of this patent is extended or adjusted under 35 U.S.C. 154(b) by 0 days.

(21) Appl. No.: 10/096,062

(22) Filed: Mar. 12, 2002

(65) Prior Publication Data

US 2003/0172836 A1 Sep. 18, 2003

(51) Int. Cl.[7] ..... B61D 17/00
(52) U.S. Cl. ..... 105/404
(58) Field of Search ..... 105/1.4, 3, 4.1, 105/8.1, 355, 396, 404, 406.1

(56) References Cited

U.S. PATENT DOCUMENTS

| | | | | |
|---|---|---|---|---|
| 138,476 A | | 5/1873 | Caldwell | |
| 387,382 A | | 8/1888 | Weems | |
| 482,951 A | | 9/1892 | Stratton et al. | |
| 888,286 A | | 5/1908 | Wilhite | |
| 1,039,585 A | | 9/1912 | Pascal | |
| 1,550,239 A | | 8/1925 | Billings et al. | 414/339 |
| 1,870,575 A | | 8/1932 | Kiesel, Jr. | |
| 1,920,500 A | | 8/1933 | Garcia et al. | 414/339 |
| 2,052,867 A | | 9/1936 | Cartzdafner et al. | 105/406 |
| 2,091,721 A | | 8/1937 | Soderberg et al. | 105/410 |
| 2,101,698 A | | 12/1937 | Anderson | 105/276 |
| 2,457,267 A | * | 12/1948 | Peale et al. | 414/339 |
| 2,793,597 A | | 5/1957 | Walters | 105/8 |
| 2,839,010 A | * | 6/1958 | Harbulak | 105/1.4 |
| 2,906,212 A | | 9/1959 | Hayes | 104/137 |
| 3,093,216 A | | 6/1963 | Dunham | 105/422 |
| 3,185,108 A | | 5/1965 | Muller | 104/25 |
| 3,290,058 A | * | 12/1966 | Ellerd | 280/410 |
| 3,540,380 A | | 11/1970 | Tumpak et al. | 104/246 |
| 3,896,945 A | | 7/1975 | Bjorklund et al. | 105/4.1 |
| 3,922,971 A | | 12/1975 | Maroshick | 105/4.1 |
| 4,099,635 A | | 7/1978 | Leonard et al. | 214/152 |
| 4,128,180 A | | 12/1978 | Mellious | 214/44 A |
| 4,318,345 A | | 3/1982 | Kleim | 105/15 |
| 4,345,869 A | * | 8/1982 | King | 414/520 |
| 4,355,940 A | * | 10/1982 | Derickson | 414/439 |
| 4,579,063 A | | 4/1986 | Losa et al. | 280/403 |
| 4,644,872 A | | 2/1987 | Vianello et al. | 105/8.1 |

(List continued on next page.)

FOREIGN PATENT DOCUMENTS

| | | | |
|---|---|---|---|
| DE | 533304 | 9/1931 | 81/55 |
| DE | 1481286 | 2/1969 | 81/104 |
| GB | 898911 | 6/1962 | 78/E5 |

*Primary Examiner*—S. Joseph Morano
*Assistant Examiner*—Robert J. McCarry, Jr.
(74) *Attorney, Agent, or Firm*—Howrey Simon Arnold & White LLP

(57) ABSTRACT

A railroad car for use with a train of like railroad cars is disclosed. In one embodiment, the railroad car is a continuous gondola car used to transport and unload replacement beams for a railroad bridge. The gondola car has a continuous bay defined by a floor extending between two sidewalls. A bridge extends from the floor of gondola car and overlays a portion of a floor of the adjacent gondola car. One or more guides are mounted along the floor of the continuous bay. The beams are supported and moved in the central bay by one or more supports movable along the one or more guides. The guides of the gondola car communicate with the guides of the adjacent gondola car. The beams may be moved from one car to another during unloading at least when the cars are substantially aligned or when they a pivoted in relation to one another.

30 Claims, 7 Drawing Sheets

U.S. PATENT DOCUMENTS

| | | | | |
|---|---|---|---|---|
| 4,712,965 | A | | 12/1987 | Canziani ..... 414/339 |
| 4,723,886 | A | | 2/1988 | Frederking ..... 414/339 |
| 4,754,710 | A | | 7/1988 | Kieres ..... 105/335 |
| 4,766,818 | A | | 8/1988 | Wicks et al. ..... 280/408 |
| 4,829,907 | A | | 5/1989 | Theurer et al. ..... 104/5 |
| 4,830,562 | A | | 5/1989 | Frederking ..... 414/339 |
| 4,909,699 | A | | 3/1990 | Tandy et al. ..... 414/528 |
| 4,911,599 | A | | 3/1990 | Theurer et al. ..... 414/339 |
| 4,958,977 | A | | 9/1990 | Snead ..... 414/339 |
| 5,129,327 | A | * | 7/1992 | Snead ..... 105/4.1 |
| 5,191,842 | A | | 3/1993 | Tinkler ..... 105/355 |
| 6,089,816 | A | * | 7/2000 | Christ ..... 414/538 |

* cited by examiner

RAILROAD CAR WITH SYSTEM FOR TRANSPORTING AND UNLOADING CARGO

FIELD OF THE INVENTION

The disclosed invention relates generally to a material transport system and, more particularly to a material transport system having a continuous railroad car with a support and transfer system for transporting and unloading cargo.

BACKGROUND OF THE INVENTION

Current procedures to replace a railroad bridge involve bringing replacement beams to the bridge site using standard gondola or flat cars. Unfortunately, continually feeding the replacement beams to a track crane is not possible using the standard gondolas or flat cars. Consequently, the replacement beams are brought days before the actual installation. The on-line track crane must unload the replacement beams into a track shoulder near the bridge. This requires a first work window to be scheduled to coordinate the operation of the track crane, a locomotive, and a crew to unload the replacement beams from the cars. Then, another work window must be scheduled on the day of installation to retrieve the replacement beams from the track shoulder and to install them at the bridge site. Therefore, there exists a need in the art for a material transport system that can continually feed replacement bridge beams to a track crane.

The disclosed invention is directed to overcoming, or at least reducing the effects of, one or more of the problems discussed above.

SUMMARY OF THE INVENTION

The disclosed invention provides a material transport system for transporting cargo to a location and unloading the cargo at the location. In one embodiment of the disclosed invention, the material transport system includes a plurality of continuous rail cars. Each of the rail cars includes a floor. Intermediate rail cars have a bridge extending from the floor that overlays a portion of an adjacent rail car. An articulated coupling of the rail car with the adjacent car is positioned adjacent the bridge and enables pivotable movement of the cars relative to one another.

The material transport system includes a support and transfer system for the cargo. The support and transfer system includes one or more guides and one or more supports. The one or more guides are mounted to each floor of the rail cars. In one embodiment of the disclosed invention, among others, each guide may include a transition communicating with an adjacent transition of an adjacent car. In one embodiment of the disclosed invention, among others, each of the one or more guides may include a channel defined by first and second channel walls mounted to the floor of each rail car. In one embodiment of the disclosed invention, among others, each of the one or more guides may include a flared portion communicating with an adjacent flared portion of an adjacent car. Each flared portion may be defined by channel walls of each guide angling away from one another.

The one or more supports are used to support and move the cargo on the floor. The one or more guides are used to guide the movement of the one or more supports. The supports are movable along the one or more guides to transfer the cargo between cars. In one embodiment of the disclosed invention, among others, each of the one or more supports may include a support member having one or more motive members attached thereto. In one embodiment of the disclosed invention, among others, each motive member may include a structure movable in a channel defined by first and second channel walls of one of the guides. In one embodiment of the disclosed invention, among others, a plurality of guide rollers may be disposed on the motive member adjacent the structure to prevent the structure from binding on the channel walls of the guides.

The foregoing summary is not intended to summarize each potential embodiment, or every aspect of the invention disclosed herein. Furthermore, the foregoing summary is not intended to summarize the appended claims, which follow, but merely to summarize some aspects of the disclosed invention, among other aspects.

BRIEF DESCRIPTION OF THE DRAWINGS

The foregoing summary, a preferred embodiment, and other aspects of the disclosed invention will be best understood with reference to a detailed description of specific embodiments of the invention, which follows, when read in conjunction with the accompanying drawings, in which.

Figure 1A:
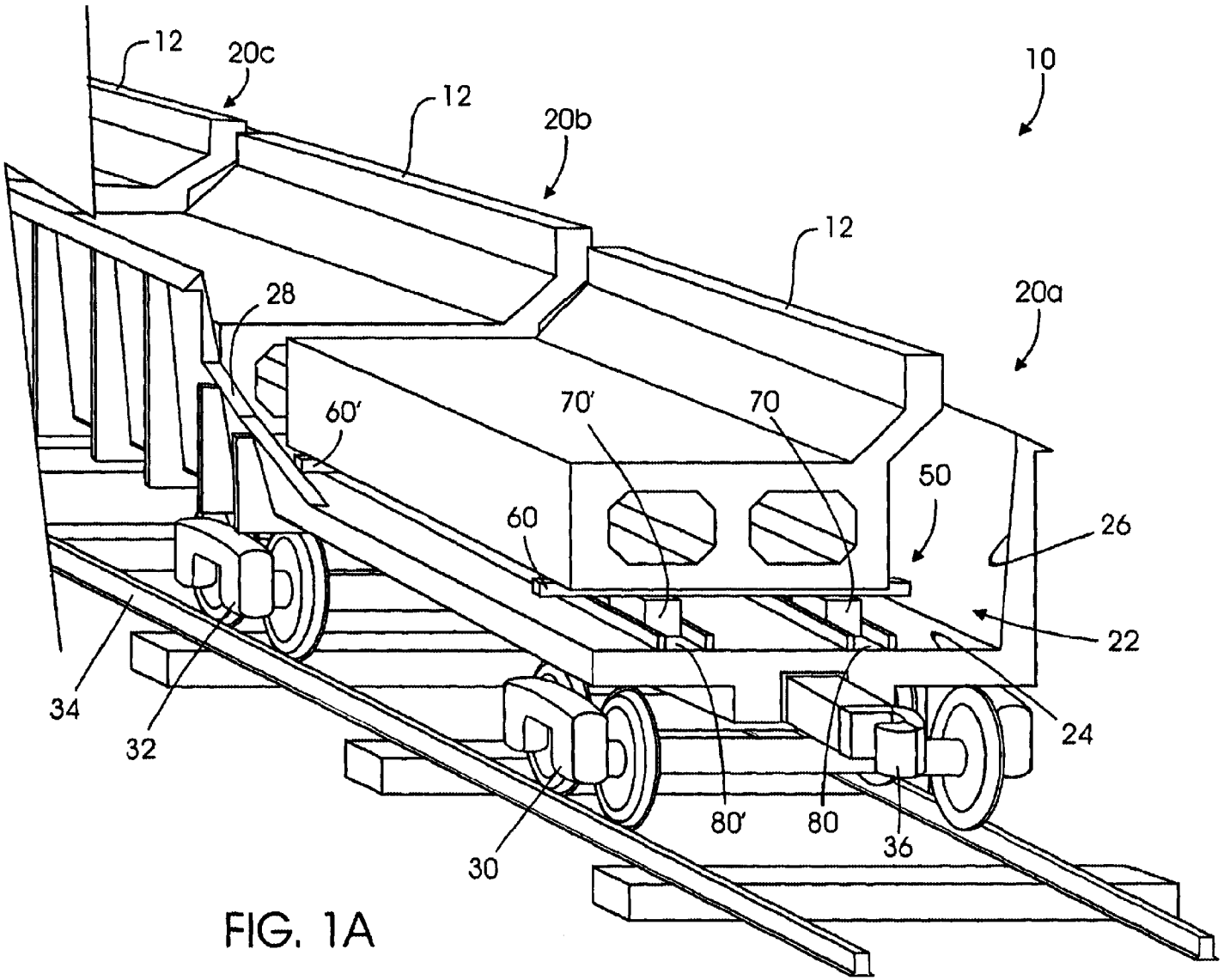
FIG. 1A illustrates a perspective view of an embodiment of a material transport system in accordance with the disclosed invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the scope of the invention as defined by the appended claims.

DETAILED DESCRIPTION OF THE INVENTION

Figure 1B:
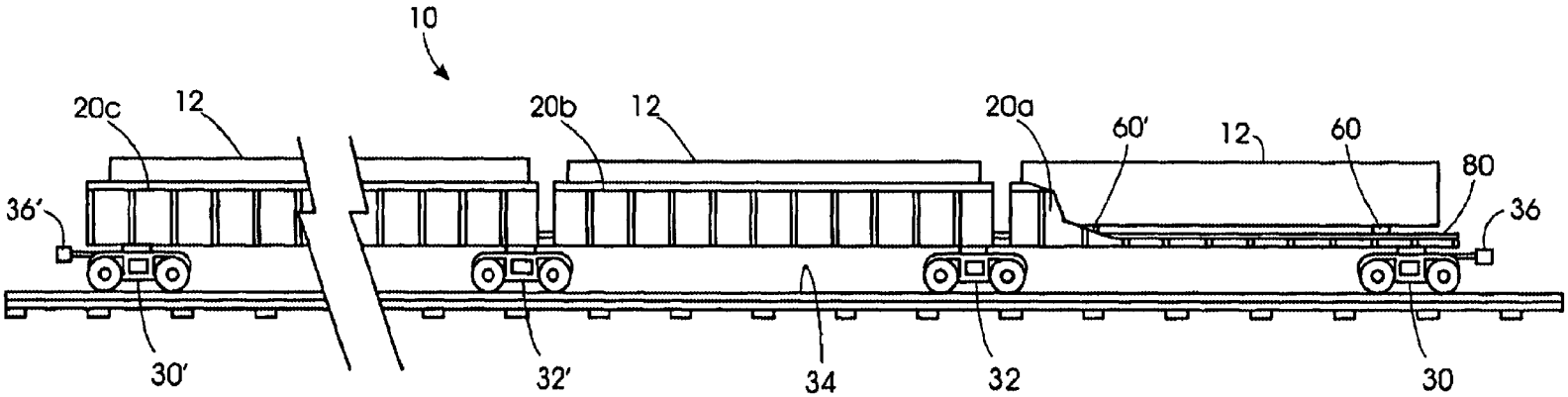
FIG. 1B illustrates a side view of the material transport system of FIG. 1A.
Figure 1C:
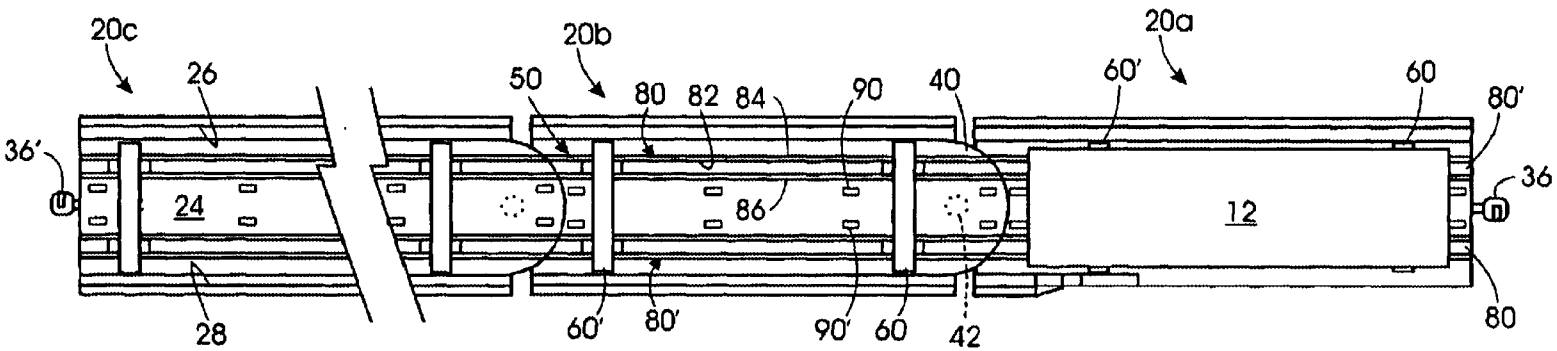
FIG. 1C illustrates a top view of the material transport system of FIG. 1A.

Referring to FIGS. 1A–C, a material transport system 10 in accordance with the disclosed invention is illustrated. In FIGS. 1A–C, a perspective view, a side view, and a top view respectively of the material transport system are illustrated.

The material transport system 10 includes one or more units or containers 20 having a support and transfer system 50. The support and transfer system 50 is used to support cargo 12 in the units or containers 20 during transport. The support and transfer system 50 is also used to unload the cargo 12.

In the illustrated embodiment of the disclosed invention, the units or containers 20 of the material transport system 10 are rail cars. In particular, the rail cars 20 are continuous gondola cars, which are substantially similar to those disclosed in U.S. Pat. No. 4,958,977 or U.S. Pat. No. 5,129,327, both of which are incorporated herein by reference in their entirety. The cargo 12 may include, but is not limited to, prefabricated concrete structures, bridge spans, beams, pier caps, or other cargo best transported by rail. Although the illustrated embodiment of the material transport system 10 is a train of continuous gondola cars, the units or containers 20 of the disclosed invention may apply to other material transport systems. Furthermore, the support and transfer system 50 of the disclosed invention may apply to other forms of cargo. For example, the support and transfer system 50 may be suitable for unloading cargo from units or containers, such as barges, trucks, or various types of railroad cars other than gondola cars.

Each gondola car 20 includes a continuous bay 22 defined by a floor 24 extending for the length of the car 20. Motive members or railroad trucks 30 and/or 32 are pivotally connected to the floor 24 and allow the car 20 to ride on railroad tracks 34 from a loading site to a work site. Each gondola car 20 lacks bulkheads at the ends of the continuous bay 22. For example, one end of the first gondola car 20*a* communicates with the adjacent gondola car 20*b*, while the other end of the first car 20*a* may be open to load or unload cargo 12 from the material transport system 10. In one embodiment of the disclosed invention, among others, the continuous bay 22 may be approximately 33'4" long and approximately 8'6" wide at its base.

The continuous bay 22 may be further defined by the floor 24 extending between sidewalls 26 and 28. The sidewalls 26 and 28 of each gondola car 20 may connect with the sidewalls of adjacent gondola cars to create continuous sidewalls along the length of the material transport system 10. For example, in one embodiment, overlapping portions (not shown), such as disclosed in U.S. Pat. No. 4,958,977 and incorporated herein by reference, may be used between adjacent cars 20 to create continuous sidewalls along the length of the material transport system 10. In another embodiment, wall transitions (not shown), such as disclosed in U.S. Pat. No. 5,129,327 and incorporated herein by reference, may be used between adjacent cars 20 to create continuous sidewalls along the length of the material transport system 10. In the present embodiment of the material transport system 10 used to transport and unload large and heavy cargo, such as bridge beams, it is preferred that the sidewalls 26 and 28 include overlapping sections between cars 20.

As best depicted in FIG. 1C, a second or intermediate gondola car 20*b* has a bridge 40 extending from the floor 24. The bridge 40 overlaps a portion 46 of the floor 24 of the adjacent, first gondola car 20*a*. The intermediate gondola car 20*b* is pivotally connected to the first gondola car 20*a* at an articulated coupling or pivotable connection 42 positioned adjacent the bridge 40. A railroad truck 32 is positioned at the articulated coupling 42 between the first and second gondola cars 20*a* and 20*b*. The articulated coupling 42 enables pivotable movement of the first gondola car 20*a* relative to the second gondola car 20*b*. When the cars 20*a* and 20*b* are pivoted, the bridge 40 moves over the floor 24 of the adjacent gondola car 20*a* as the cars negotiate a curve.

Additional intermediate gondola cars, similar to the intermediate gondola car 20*b*, may be similarly connected in series to form the material transport system 10. Throughout the material transport system 10, each pivotally connected, intermediate gondola car 20*b* includes a similar bridge 40 that overlaps in the same direction along the material transport system 10. The overlapping bridges 40 allow the cargo 12 to be transferred along the material transport system 10 without encountering gaps between cars.

In the illustrated embodiment of the disclosed invention, the first or end gondola car 20*a* has an end truck 30 mounted in conventional fashion at the end of the material transport system 10. The end gondola car 20*a* includes a standard coupling 36 to allow the gondola car 20*a* to be coupled to other railroad cars or to a locomotive. The last gondola car 20*c* may have a standard coupling 36' to allow the material transport system 10 to be coupled to other railroad cars or to a locomotive. In one embodiment of the disclosed invention, among others, each gondola car 20 may have a span of approximately 33⅓-ft. between its articulated couplings 42. With the 33⅓-ft. span for each gondola car 20, the material transport system 10 may negotiate approximately twenty-seven degrees per one hundred feet of curvature in the rail line. In negotiating such a curve, the maximum angle between adjacent cars may be approximately nine degrees.

As noted above, the support and transfer system 50 is used to support the cargo 12 in the gondola cars 20 during transport. The support and transfer system 50 is also used to transfer the cargo 12 between the gondola cars 20 during unloading or loading. The system 50 includes one or more supports or dollies 60 and one or more guides or tracks 80. The one or more supports 60 are used to support the cargo 12 in the cars 20. The one or more guides 80 are mounted on the floors 24 of the cars 20. The guides 80 run the length of the continuous bays 22 and communicate with the guides of adjacent gondola cars. The supports 60 are used to move the cargo 12 in and between the cars 20, and the guides 80 are used to guide the movement of the supports 60 in and between the cars 20.

The supports 60 include one or more motive or roller members 70. The motive members 70 are movable along the guides 80 and may be transferred between the gondola cars 20. The overlapping bridges 40 allow the motive members 70 of the supports 60 to traverse the juncture between adjacent gondola cars 20 without encountering gaps between floors 24. Preferably, the transfer of the supports 60 between cars 20 is substantially smooth and controlled.

In the present embodiment of the disclosed invention for transporting and unloading large and heavy cargo, such as bridge beams, two guides 80 and 80' are disposed in parallel along the floor 24 of each gondola car 20. Each guide 80 and 80' includes a channel 82 formed by parallel channel walls or longitudinal flanges 84 and 86 mounted on the floors 24 of the gondola cars 20. It is understood that another configuration or number of guides 80 and 80' is possible depending on the particular cargo to be transported and unloaded. In other embodiments, for example, the guide 80 may include a track, a raised rail, a longitudinal slot, a groove, a single sidewall, or other means for guiding the support 60 when moved within the cars 20.

In the present embodiment of the disclosed invention for transporting and unloading large and heavy cargo, such as bridge beams, a first support 60 and a second support 60' are used in each gondola car 20 to support the large, heavy cargo or bridge beam 12. It is understood that another configuration or number of supports 60 may be used depending on the particular cargo to be transported and unloaded. In the present embodiment of the invention, each support 60 includes first and second motive members 70 and 70'. The first motive member 70 is movably disposed in the channel 82 of the first guide 80, and the second motive member 70' is movably disposed in the channel 82 of the second, parallel guide 80'.

Figure 2A:
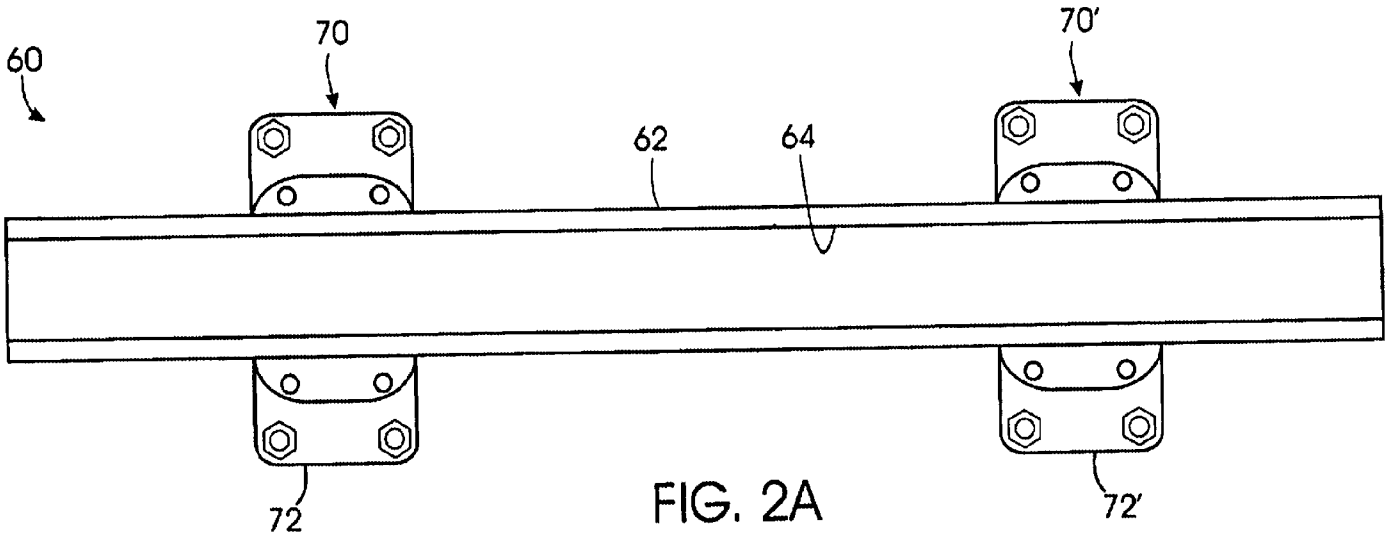
FIG. 2A illustrates a top view of an embodiment of a support in accordance with the disclosed invention.
Figure 2B:
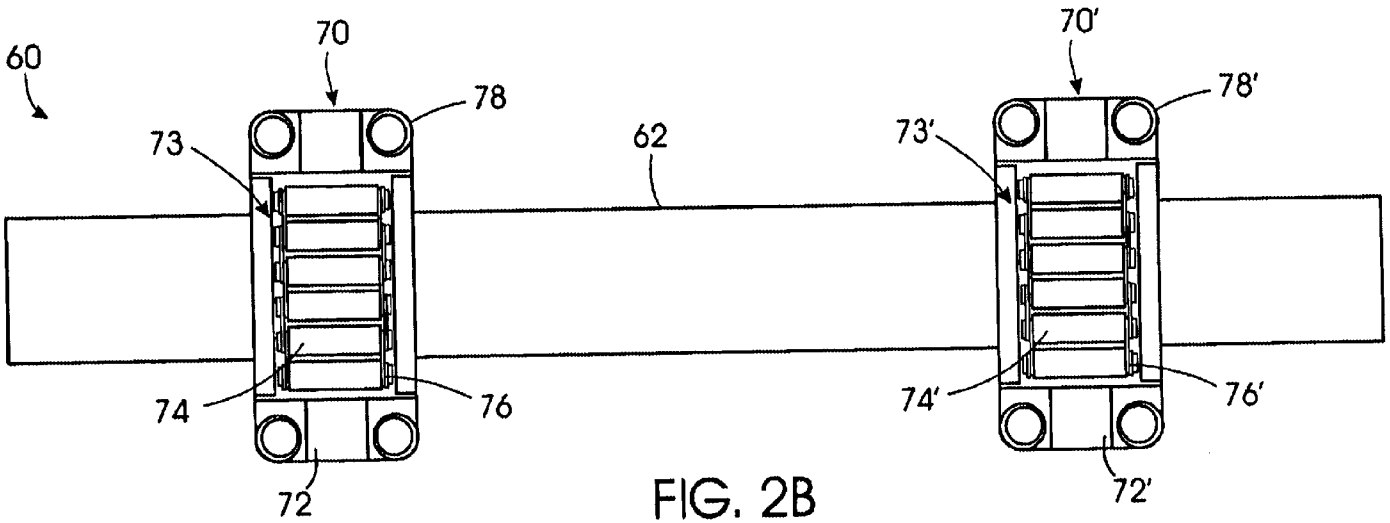
FIG. 2B illustrates a bottom view of the support of FIG. 2A.

Referring to FIGS. 2A–B, a preferred embodiment of a support or dolly 60 is illustrated in accordance with the disclosed invention. In FIG. 2A, the support 60 is depicted in a top view; and in FIG. 2B, the support 60 is depicted in a bottom view. The support 60 in FIGS. 2A–B may be particularly suitable for transporting and unloading large and heavy cargo, such as bridge beams. The support 60 includes a support member 62 and first and second motive or roller members 70 and 70'. The support member 62 is a cross member that extends laterally across the continuous bay of the gondola car (not shown) in which it is disposed. The first and second motive members 70 and 70' are attached to the cross member 62.

In one embodiment of the support 60, among others, the motive members 70 and 70' are fixedly attached to the cross member 62. In another embodiment of the support 60, the motive members 70 and 70' may be pivotally attached to the cross member 62. Pivotally attached motive members 70 and 70' would allow the angle between the members 70 and 70' and cross member 62 to change. This may facilitate the transfer of the support 60 between gondola cars when situated on a curve. However, having the motive members 70 and 70' fixedly attached to the cross member 62 is sufficient for the present embodiment.

As best depicted in FIG. 2A, the cross member 62 may further include a receptacle or well 64, which may hold additional support structures (not shown) for sustaining the cargo. For example, the additional support structure may be a spacer composed of wood or other material. The spacer may be placed in the receptacle or well 64 to provide a durable surface to contact the cargo to be supported by the cross member 62. Additionally, if the cargo has a unique shape, such as a cylinder, or if the cargo is a set of objects, such as a set of pipes, an appropriately contoured structure may be disposed in the receptacle or well 64 of the cross member 62 to support the special cargo.

As best shown in FIG. 2B, each motive or roller member 70 and 70' includes a body 72 and 72'. In one embodiment, among others, the body 72 and 72' may house one or more rollers, wheels, or bearings (not shown). The one or more rollers, wheels, or bearings may at least sustain twenty tons, which may be sufficient for supporting 30-ton beams with two roller members 70 and 70'. In a preferred embodiment of the support 60, the body 72 and 72' includes a roller structure 73 and 73' disposed on the body 72 and 72'. The roller structure 73 and 73' are disposable in the channel of a guide and are movable along the channel between the channel walls. The roller structure 73 and 73' has a plurality of roller bearings 74 and 74' interconnected to one another with a pair of chains 75 and 75'. Such a roller structure 73 and 73' is available from Hilman Rollers Inc. and may sustain as much as several hundred tons.

In a further embodiment of the support 60, among others, each motive member 70 and 70' includes guide rollers 76 and 76' attached to each comer of the body 72 and 72' and adjacent the roller structure 73 and 73'. The guide rollers 76 and 76' are cylindrical or annular bearings projecting from the bottom of the body 72 and 72' and are slightly skewed inward toward the roller structure 73 and 73'. The guide rollers 76 and 76' help to keep the roller structure 73 and 73' from binding on the channel walls of the guides.

It is understood that the present embodiment of the support 60 having the single cross member 62 with the two roller members 70 and 70' is only one example of a support in accordance with the disclosed invention for supporting and moving cargo. As only one example, the present embodiment of the support 60 is not intended to limit the scope of the disclosed invention. Depending on the weight and size of the intended cargo for the support and transfer system 50, the support 60 may have more or fewer motive members 70. Furthermore, the motive members 70 on the support 60 may include rollers, wheels, bearings, treads, or other means for moving along the guides. In addition, the support member 62 need not be a lateral bar, such as the cross member in the present embodiment. Depending on the size and shape of the intended cargo, the support member 62 may have other shapes or arrangements.

In one alternative embodiment of the disclosed invention, among others, the support may include a support member that is a platform or frame (not shown) having a motive member pivotally connected at each corner. This embodiment may be sufficient for transporting cargo other than bridge beams as disclosed herein with reference to the illustrated embodiment. Accordingly, it is understood that the one or more guides and the one or more motive members may have a number of different configurations in accordance with the disclosed invention and that the illustrated embodiments discussed herein should not be interpreted to limit the use of other configurations of guides and motive members.

Returning to FIGS. 1A–C, the disclosed invention facilitates transporting and unloading of the cargo 12 from the material transport system 10. In the example implementation of the disclosed invention, the material transport system 10 may be used during replacement of a bridge on a rail line. The material transport system 10 may include a series of continuous gondola cars 20*a–c* that are each approximately 33 ft. in length. Each gondola car 20 may hold a bridge beam 12 that has a length of approximately 30-ft. and a weight of approximately 30 tons.

To carry the bridge beams 12, two supports 60 and 60' are used to support each beam 12 in each car 20. Adjustable stops 90 and 90' at the ends of the bridge beams 12 may secure the beams 12 during transport to the work site. The adjustable stops 90 may contact the cargo 12 or the supports 60 and 60' to prevent the cargo 12 from moving in the bay 22 during transport. As best shown in FIG. 1C, the adjustable stops 90 may be positioned throughout the floor 24 of each gondola car 20 to accommodate different sizes of beams within the continuous bay 22.

Figure 3:
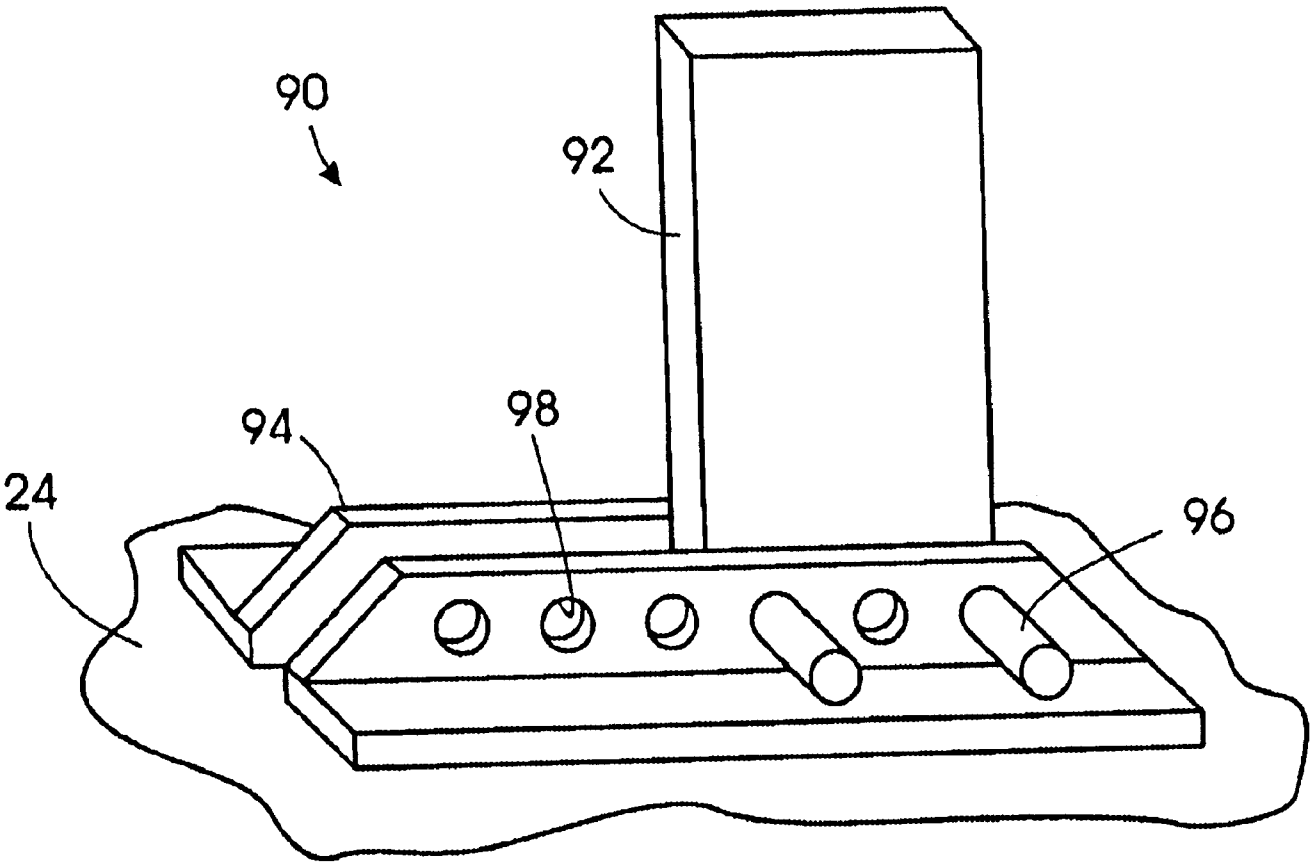
FIG. 3 illustrates a perspective view of an embodiment of an adjustable stop in accordance with the disclosed invention.

Referring briefly to FIG. 3, an embodiment of an adjustable stop 90 in accordance with the disclosed invention is illustrated in a perspective view. The adjustable stop 90 includes a stop or bar 92, a fixture 94, and retainers 96. The stop 92 is a thin bar of material mounted in the fixture 94 on the floor 24 of the car. The fixture 94 is a pair of parallel flanges attached to the floor 24 of the car. The stop or bar 92 extends from the floor 24 of the car 20 and contacts the cargo or the support to prevent shifting of the cargo during transport. The stop or bar 92 is held in place in the fixture 94 with retainers or pins 96 positioned through holes 98 in the fixture 94 and bar 92. A redundant number of holes 98 is provided, allowing the position of the bar 92 to be adjusted in the fixture 94. The bar 92 may be removed prior to unloading of the cargo by removing the pins 96 that hold the bar 92 in place in the fixtures 94.

Returning to FIGS. 1A–C, after the adjustable stops 90 and 90' are removed, a mechanism (not shown) may be used to advance the beams 12 along the continuous bay 22 from gondola car to gondola car. The supports 60 and 60' are moved along the guides 80 and 80' to transfer the beams 12 between the gondola cars 20. The motive members 70 and 70' preferably create low friction when the beams 12 are moved along the guides 80 and 80'. The mechanism for advancing the beams 12 along the continuous bay 22 from gondola car to gondola car may be a winch and a hydraulic system at the end of the material transport system 10. The winch and hydraulic system may provide sufficient power to move the bridge beams 12 down the series of cars 20 and may move the beams 12 at approximately thirty-five feet per minute.

In one embodiment of the disclosed invention, among others, the winch and hydraulic system may be provided by the railroad using the material transport system 10. For example, the track crane used to lift the beams 12 may supply the mechanism for moving the bridge beams along the material transport system 10. In another embodiment of the disclosed invention, a winch (not shown) may be mounted on the floor 24 of the end car of the material transport system 10. The winch may have sufficient cable (not shown) to run the entire length of the train, which may be approximately 375' in the present embodiment.

It is understood that the cable and winch may be appropriately sized to provide sufficient force to move the intended cargo along the material transport system 10. For example, the winch may need to provide approximately 6000 lbs. of force in the present embodiment to move 30-ton beams. Of course, the cable must be able to sustain such a load. Determining appropriate values for the winch and cable for a specific implementation, however, lies within the ordinary skill of one in the art with the benefit of the present disclosure.

In unloading the material transport system 10, the bridge beams 12 may be continuously advanced down the length of the series of cars 20 to the track crane adjacent the end or lead car 20*a*. A second winch and hydraulic system at the other end of the material transport system 10 may be used to stop or hold the advance of the bridge beams 12 if the material transport system 10 is on a slight grade. Because the beams 12 may be continuously fed to the lead car 20*a*, much of the handling of the beams 12 is eliminated as previously done by track cranes in the past. The continuous feed of the bridge beams 12 to the end of the material transport system 10 eliminates the need for an initial work schedule to unload the beams 12 and a subsequent work schedule to install the beams 12 with the track crane. The action of unloading the beams directly from the material transport system 10 may be combined with the action of installing the beams 12, which considerably speeds up the process. Another, empty material transport system (not shown) on the opposite side of the bridge may receive the old bridge components when removed.

In one embodiment of the disclosed invention, among others, the support and transfer system 50 allows the supports 60 to move the cargo 12 from gondola car to gondola car when the cars are at least substantially aligned. In a preferred embodiment of the disclosed invention, the support and transfer system 50 allows the supports 60 to move the cargo 12 from gondola car to gondola car even when the material transport system 10 is situated on a curve. Although FIGS. 1A–C show guides 80 and 80' that are able to transfer the supports 60 between cars 20*a–c* when the cars are at least substantially aligned, further details regarding a preferred embodiment of the support and transfer system 50 are provided below.

Figure 4:
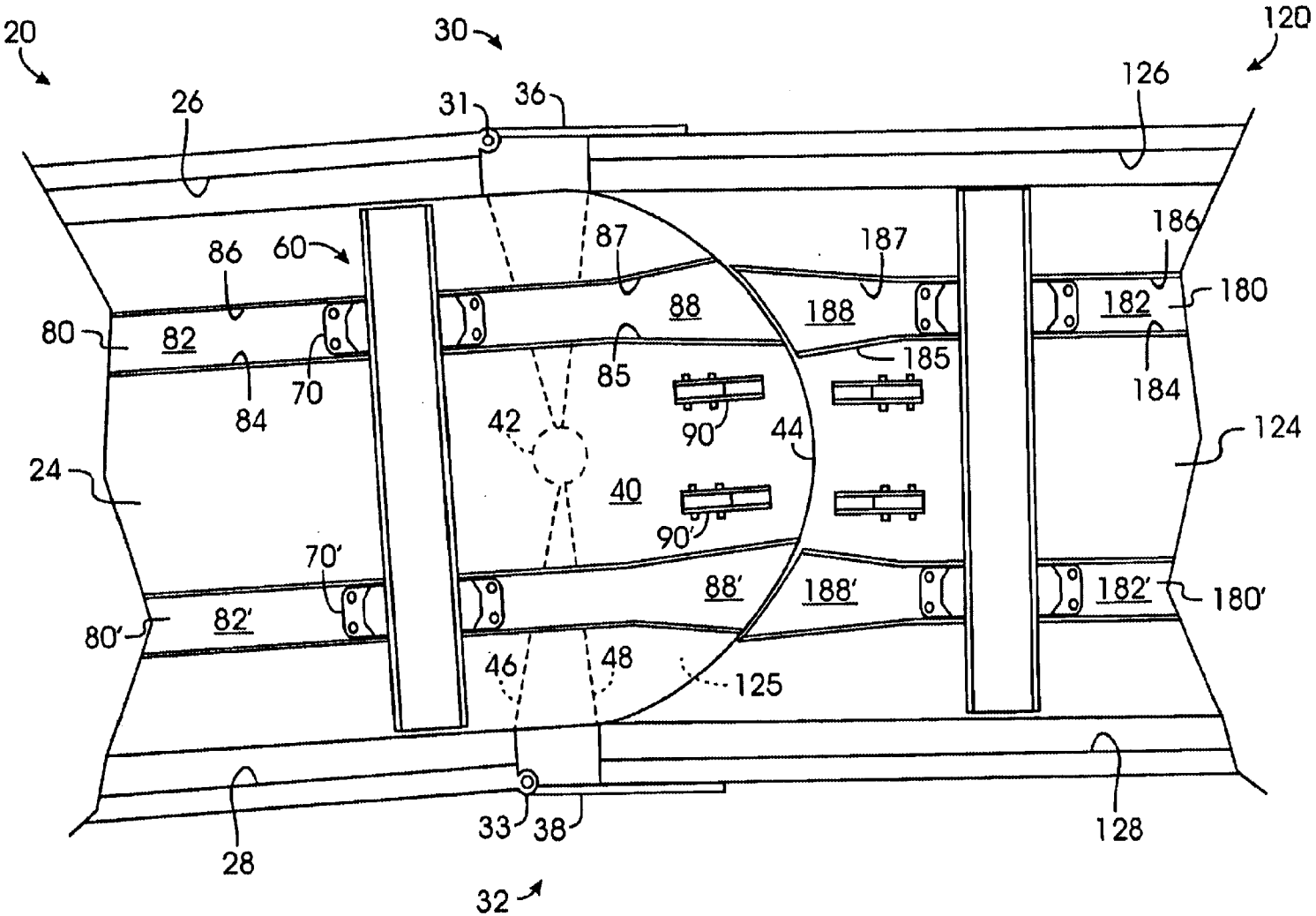
FIG. 4 illustrates a top view of a first gondola car pivoted in relation to an adjacent gondola in accordance with the disclosed invention.

Referring to FIG. 4, a partial, top view of a first gondola car 20 connected to an adjacent, second gondola car 120 is illustrated. The first and second gondola cars 20 and 120 are situated on a slight curve in the railroad tracks so that the first car 20 is pivoted in relation to the second car 120.

In FIG. 4, further details of the bridge 40 and articulated coupling 42 are illustrated in accordance with the disclosed invention. The first gondola car 20 includes the bridge portion 40 that is integral to the floor 24 and that overlaps a portion 125 of the floor 124 of the second gondola car 120. The articulated coupling or pivotable connection 42 between the cars 20 and 120 is positioned adjacent the bridge 40. In particular, the pivotable connection 42 is made between prismatic undercarriages 46 and 48 at the ends of the cars 20 and 120. The shape and angling of these prismatic undercarriages 46 and 48 is designed to prevent abutment between the ends of the cars 20 and 120.

As noted above, in one embodiment of the disclosed invention, overlapping portions, such as disclosed in U.S. Pat. No. 5,129,327, may be used between adjacent cars 20 to create continuous sidewalls along the length of the material transport system. In FIG. 4, one embodiment of overlapping portions 30 and 32 is illustrated in accordance with the disclosed invention. The overlapping portions 30 and 32 respectively include a first side panel 36 and a second side panel 38. The first side panel 36 acts to close the gap between the sidewalls 26 and 126 of the adjacent cars 20 and 120. The second side panel 38 acts to close the gap between the sidewalls 28 and 128 of the adjacent cars 20 and 120.

The first and second side panels 36 and 38 are respectively attached to the sidewalls 26 and 28 by a biased hinge 31 and 33. The hinges 31 and 33 exert torque on the panels 36 and 38 so that the panels maintain continuous forced engagement with the fixed sidewalls 126 and 128 of the adjacent gondola car 120. When the cars 20 and 120 negotiate a curve, the side panels 36 and 38 pivot on the biased hinges 31 and 33 while maintaining a strong force against the sidewalls 126 and 128. Similar side panels 36 and 38 may overlap in the same direction along the length of the material transport system.

With the cars 20 and 120 pivoted in relation to one another about the articulated coupling 42, an edge 44 of the bridge 40 has been moved relative to the second floor 124. In the present embodiment, the edge 44 defines a radius R of approximately 42⅛-inches with the center of the radius R at the articulated coupling 42. A first pair of parallel guides 80 and 80' is mounted to the floor 24 of the first gondola car 20. The first guides 80 and 80' extend to the edge 44 of the bridge 40. A second pair of parallel guides 180 and 180' is mounted to the floor 124 of the second gondola car 120. The second guides extend nearly to the edge 44 of the bridge 40. Each guide 80, 80', 180, and 180' includes a channel 82, 82', 182, and 182' formed by first and second channel walls 84 and 86 mounted to the floor 24 and 124 of each car 20 and 120.

For the support 60 to successfully move or transfer between the cars 20 and 120, the guides 80 and 80' of the first car 20 must properly communicate with the adjoining guides 180 and 180' of the adjacent car 120. To communicate the adjoining guides between the cars, each guide 80, 80', 180, and 180' respectively includes a transition or flared portion 88, 88', 188, and 188'. Focusing in particular on the adjoining guides 80 and 180, the first guide 80 includes a first or bridge transition 88 on the bridge 40 between the cars 20 and 120. The adjoining guide 180 includes a second or adjoining transition 188 adjacent the bridge 40 on the floor 124. The other guides 80' and 180' are axisymmetric to the adjoining guides 80 and 180.

The roller members 70 and 70' of the support 60 are respectively disposed in the guides 80 and 80'. Guided by the channel walls 84 and 86, the roller members 70 and 70' may move into the transitions 88 and 88' of the first car 20. From the bridge transitions 88 and 88', the roller members 70 and 70' may move into the adjoining transitions 188 and 188' of the adjacent car 120 without encountering protruding edges of the channel walls 184 and 186. Thus, the support 60 with cargo (not shown) may be readily transferred between the gondola cars 20 and 120 when the material transport system is situated on a curve in the railroad tracks.

Figure 5A:
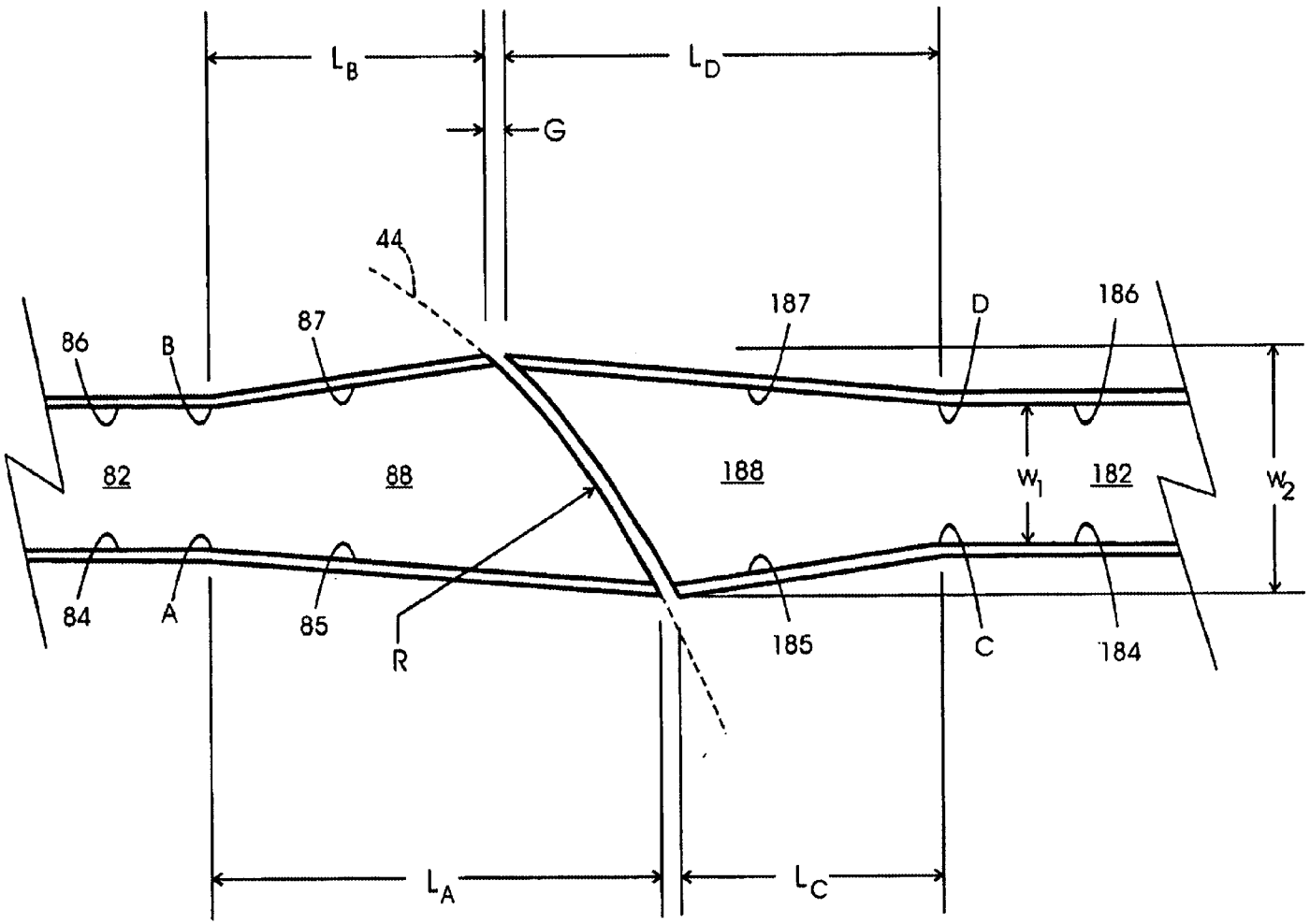
FIG. 5A schematically illustrates embodiments of adjacent transitions of a first guide of a first gondola car in relation to an adjoining guide of an adjacent gondola car in accordance with the disclosed invention.
Figure 5B:
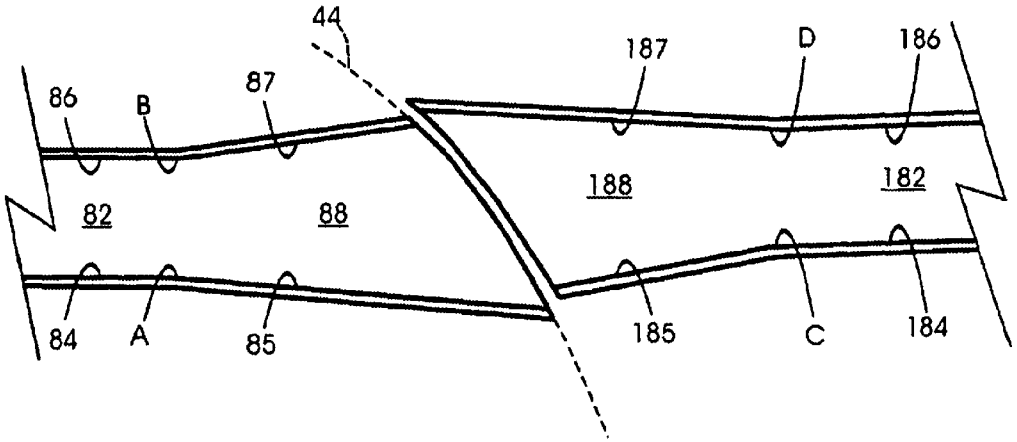
FIG. 5B schematically illustrates the adjacent transitions of FIG. 5A oriented at a maximum angle of articulation for unloading cargo.
Figure 5C:
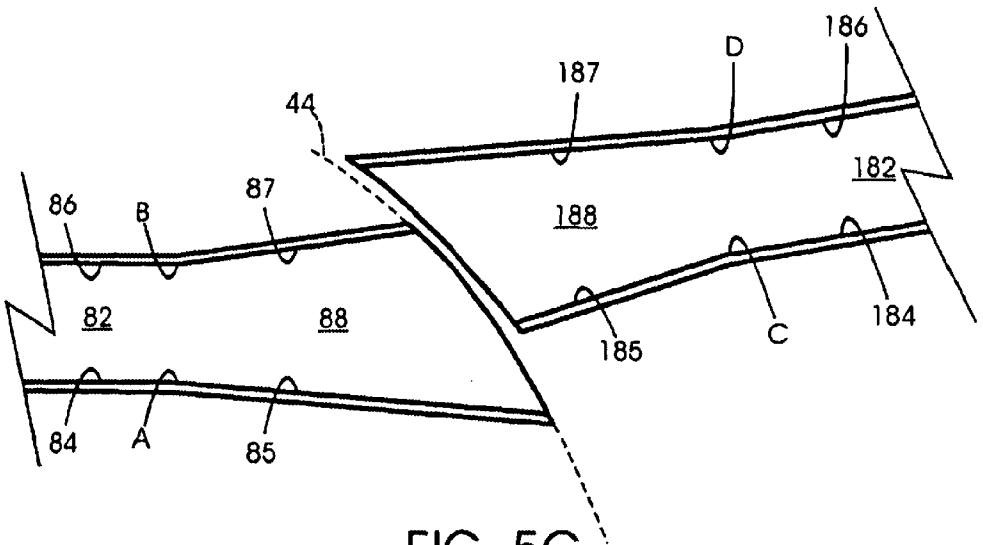
FIG. 5C schematically illustrates the adjacent transitions of FIG. 5A oriented at a maximum angle of articulation when navigating a curve.

Referring to FIGS. 5A–C, the first or bridge transition 88 and the second or adjoining transition 188 are schematically illustrated in further detail. As best shown in FIG. 5A, the first or bridge transition 88 defines a flared or widened portion of the guide 80 adjacent the edge 44 of the bridge portion (not shown). The walls 84 and 86 of the channel 82 respectively include outward angles A and B so that a first wall flare 85 and a second wall flare 87 form the transition 88. Similarly, the walls 184 and 186 of the channel 182 respectively include outward angles C and D so that a first wall flare 185 and a second wall flare 187 form the transition 188.

In the present embodiment, the standard width $W_1$ of the channels 82 and 182 is approximately 8-inches. The transitions 88 and 188 flare to a width $W_2$ of approximately 12-inches. The wall flares 85 and 87 of the bridge transition 88 terminate at edge 44 of the bridge, and the end of the transition 88 defines a convex arc with the radius R. The wall flares 185 and 187 of the transition 188 disposed on the floor of the adjacent car terminate just short of edge 44. The end of the transition 188 defines a concave arc with a radius slightly greater than R. Accordingly, a gap G of approximately ¾-inches is formed between the ends of the transitions 88 and 188.

For the bridge transition 88, the first wall flare 85 extends for a length $L_A$ of approximately 22⅞-inches along the axis of the channel 82 from the angle A to the termination at the edge 44. The angle A defines an angle of approximately 5-degrees from the substantially straight wall 84. The second wall flare 87 extends for a length $L_B$ of approximately 14¼-inches along the axis of the channel 82 from the angle B to the termination at the edge 44. The angle B defines an angle of approximately 8-degrees from the substantially straight wall 86.

For the adjoining transition 188, the first wall flare 185 extends for a length $L_C$ of approximately 13-inches along the axis of the channel 182 from the angle C to the termination ¾" short of the edge 44. The angle C defines an angle of approximately 9-degrees from the substantially straight wall 84. The second wall flare 87 extends for a length $L_D$ of approximately 14¼-inches along the axis of the channel 182 from the angle D to the termination at the edge 44. The angle D defines an angle of approximately 5-degrees from the substantially straight wall 186.

The center of the radius R is on the vertical axis of the articulated coupling 42 of the adjacent cars. This ensures that the ¾" gap G does not change when the cars are at an angle with respect to one another during travel or unloading. The concentric arcs formed by the ends of the transitions 88 and 188 may simply slide past one another. This is best shown below in FIGS. 5B and 5C. The operation of the transitions 88 and 188 allows the gap G to remain small and prevents interference during articulation of the couplers.

Furthermore, in the present embodiment, the gap G will always be at an angle with respect to individual roller bearings (not shown) of the motive members passing between the transitions 88 and 188. This assists in the transition of the supports from one car to another. If the gap G were parallel to the roller bearings, for example, each bearing would momentarily bear no load as it is suspended over the gap G. In the present embodiment, however, one end of the roller bearings makes the transition over the gap G first. As the support is moved further, an increasing amount of the roller bearing makes the transition over the gap G until the entire bearing passes over the gap G. This feature provides for smooth operation of the equipment and enhances the life of the channels and supports.

The illustrated embodiment of the transitions 88 and 188 in FIG. 5A enables the guide 80 to communicate with the adjoining guide 180 when the gondola cars are substantially aligned or are pivoted relative to one another. Thus, the adjoined transitions 88 and 188 may be used to unload cargo while the material transport system is situated on a slight curve in the railroad track.

In FIG. 5B, the second guide 180 is oriented at a maximum angle of articulation with respect to the first guide 80 for loading or unloading large and heavy cargo, such as bridge beams. In the present embodiment, among others, the maximum angle at which the transitions 88 and 188 can permit the transfer of the cargo is approximately 6-degrees of curvature per 100-ft of railroad track. This amount of curvature corresponds to approximately 2-degrees between cars, each with a span of 33⅓-ft between its articulated couplings.

In FIG. 5C, the second guide 180 is oriented at a maximum angle of articulation with respect to the first guide when negotiating a curve in the railroad track. In the present embodiment, among others, the maximum curve the train can negotiate is approximately 27-degrees of curvature per 100-ft of railroad track. This amount of curvature corresponds to approximately 9-degrees between cars, each with a span of 33⅓-ft between its couplings.

It will be appreciated that the dimensions discussed above with reference to FIGS. 5A–C pertain to one embodiment of the disclosed invention. Namely, the transitions 88 and 188 have been described for use with rail cars having an approximately 33⅓ ft. span between their respective couplings and having a width of approximately 8'6" at their base. Therefore, the dimensions discussed above are only exemplary and are understood not to limit the present invention.

Furthermore, the transitions 88 and 188 have been described for use with the preferred embodiment of the support described in FIGS. 2A–B for moving large, heavy cargo in the cars. Accordingly, it is understood that other embodiments of motive members and supports may be capable of traversing the juncture between the transitions 88 and 188 of FIGS. 5A–C when the cars are pivoted at an angle greater than 2-degrees between cars as shown in FIG. 5B.

Consequently, the geometry and dimensions of the transitions 88 and 188 disclosed above are dependent on the dimensions of the cars, on the motive members used, on the support used, and on the cargo transported, among other factors. Therefore, the transitions 88 and 188 discussed above in FIGS. 5A–C should not be interpreted to limit the use of other configurations of transitions. Other forms of transitions could be made to work sufficiently well with other cargo, with other forms of guides, with other motive members, or with other material transport units or containers.

In one example of other possible examples, the transitions at the end of the cars may define substantially wider and longer flares of the channels 82 and 182 and may be used with cargo that is substantially lighter than 30-ton bridge beams. The wider and longer flares may allow the motive members of the supports to make the transitions between the cars at even greater angles than shown in FIGS. 5A–C. Because the cargo is light, there may be less need for a considerably smooth and controlled transition between the cars as may be possible or required with other embodiments of the disclosed invention.

In addition, other embodiments of transitions may include having an intermediate member linked between the channels 82 and 182 of the adjoining guides 80 and 180 or may include providing a pivot on the wall flares 85, 87, 185, and 187 of the transitions 88 and 188. In another embodiment, the transitions 88 and 188 may not include wall flares 85, 87, 185, and 187 that abruptly angle outward, but instead may include wall flares (not shown) that gently curve outward to form a horn-shaped transition. Moreover, the guides 80 and 180 need not necessarily include a channel 82 formed by two sidewalls 84 and 86, but may include tracks, raised rails, longitudinal slots, grooves, single sidewalls, or other systems for guiding the support when moved within the cars as noted above. Accordingly, the transitions according to the disclosed invention may include other systems for transferring the motive members between cars that is suitable to the embodiment of the guides used.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A unit for use with an adjacent unit to transport and unload cargo, comprising:

a floor;

a bridge portion extending from the floor and overlaying a portion of the adjacent unit;

a coupling of the unit with the adjacent unit being positioned adjacent the bridge portion and enabling pivotable movement of the unit relative to the adjacent unit;

one or more guides disposed on the floor; and one or more supports for supporting the cargo in the unit, the one or more supports being movable in the unit along the one or more guides and being transferable across the bridge portion between the unit and the adjacent unit to transfer the cargo from one of the units to the other.

2. The unit of claim 1, wherein the unit is a railroad car.

3. The unit of claim 2, wherein the railroad car has a continuous bay defined by the floor extending between first and second sidewalls.

4. The unit of claim 1, father comprising one or more stops removably mounting to the floor and keeping the cargo from moving along the one or more guides.

5. The unit of claim 1, wherein each of the one or more guides communicates with an adjoining guide of the adjacent unit and allows the one or more supports to transfer between the units when the units are at least substantially aligned.

6. The unit of claim 1, wherein each of the one or more guides further comprises a transition communicating with an adjoining transition of the adjacent unit and allowing the one or more supports to transfer between the units when the units are substantially aligned or pivoted in relation to one another.

7. The unit of claim 1, wherein each of the one or more guides comprises a channel defined by first and second channel walls mounted to the floor.

8. The unit of claim 7, wherein each of the guides further comprises a flared portion adjacent the bridge portion, the flared portion defined by the first and second channel walls angling away from one another.

9. The unit of claim 8, wherein the flared portion communicates with an adjoining flared portion of the adjacent unit and allows the one or more supports to transfer between the units when the units are substantially aligned or pivoted in relation to one another.

10. The unit of claim 1, wherein each of the one or more supports comprises a support member having one or more motive members attached thereto, each of the one or more motive members movable along one of the one or more guides.

11. The unit of claim 10, wherein each of the one or more motive members comprises:

a structure disposable in a channel of the one guide and having one or more rollers positioned adjacent the floor; and a plurality of guide rollers disposed adjacent the structure and preventing the structure from binding on walls of the channel.

12. A system for transporting and unloading cargo, comprising;

a first unit having a first floor and having one or more first guides disposed on the first floor, a second unit having a second floor and having one or more second guides disposed on the second floor, the second unit having a bridge portion extending from the second floor and overlapping a portion of the first floor;

a coupling of the first unit with the second unit being positioned adjacent the bridge portion and enabling pivotable movement of the units relative to one another; and one or more supports for supporting the cargo in the units, the one or more supports being movable in the units along the first and second guides and being transferable across the bridge portion between the units to transfer the cargo from one of the units to the other.

13. The system of claim 12, wherein the first and second units each comprises a railroad car.

14. The system of claim 12, further comprising stops removably mounted to the floor and keeping the cargo from moving along the guides.

15. The system of claim 12, wherein each of the first guides communicates with an adjoining second guide and allows the one or more supports to transfer between the units when the units are at least substantially aligned.

16. The system of claim 12, wherein each of the first guides further comprises a first transition communicating with an adjoining transition of the adjoining second guide and allowing the one or more supports to transfer between the units when the units are substantially aligned or pivoted in relation to one another.

17. The system of claim 12, wherein each of the guides comprises a channel defined by first and second channel walls mounted to the floor.

18. The system of claim 17, wherein each of the first and second guides further comprises a flared portion adjacent the bridge portion, the flared portion defined by the first and second channel walls angling away from one another.

19. The system of claim 18, wherein each flared portion communicates with an adjoining flared portion of the adjacent unit and allows the one or more supports to transfer between the units when the units are substantially aligned or pivoted in relation to one another.

20. The system of claim 12, wherein each of the one or more supports comprises a support member having one or more motive members attached thereto, each of the one or more motive members movable along one of the one or more guides.

21. The system of claim 20, wherein each of the one or more motive members comprises:

a structure disposable in a channel of the one guide and having one or more rollers positioned adjacent the floor; and a plurality of guide rollers disposed adjacent the structure and preventing the structure from binding on walls of the channel.

22. A system for transporting and unloading cargo with a plurality of railroad cars comprising:

a) means for supporting the cargo on the railroad cars;

b) means for moving the supporting means in the railroad cars;

c) means for guiding the moving means; and d) means for transferring the supporting means and cargo between the railroad cars with the moving means.

23. The system of claim 22, further comprising means for securing the supporting means.

24. The system of claim 22, wherein the moving means comprises means for rolling the supporting means.

25. The system of claim 24, wherein the rolling means comprises one or more motive members disposed on a support member and movable along the guiding means.

26. The system of claim 22, wherein the guiding means comprises one or more guides disposed on a floor of the railroad cars, each guide having a channel defined by first and second channel walls.

27. The system of claim 22, wherein the transferring means further comprises means for communicating the guiding means of one railroad car with a guiding means of an adjacent railroad car when the cars are at least substantially aligned.

28. The system of claim 22, wherein the transferring means further comprises means for communicating the guiding means of one railroad car with a guiding means of an adjacent railroad car when the cars are substantially aligned or pivoted in relation to one another.

29. The system of claim 28, wherein the communicating means comprises a first transition of the guiding means of the one railroad car disposed adjacent a second transition of the guiding means of the adjacent railroad car.

30. The system of claim 29, wherein the guiding means comprises a channel formed by first and second channel walls and wherein the first transition comprises a flared portion defined by the first and second channel walls angling away from one another.

* * * * *

UNITED STATES PATENT AND TRADEMARK OFFICE

CERTIFICATE OF CORRECTION

PATENT NO. : 6,684,795 B2
DATED : February 3, 2004
INVENTOR(S) : Villar et al.

It is certified that error appears in the above-identified patent and that said Letters Patent is hereby corrected as shown below:

Column 11,
Line 60, please replace -- father -- with "further".

Signed and Sealed this

First Day of June, 2004

JON W. DUDAS
*Acting Director of the United States Patent and Trademark Office*